US006474066B1

(12) United States Patent
Lin

(10) Patent No.: US 6,474,066 B1
(45) Date of Patent: Nov. 5, 2002

(54) ELECTRIC-CONTROLLED IDLER-TYPE SUPERCHARGER

(76) Inventor: Chiways Lin, 2, Lane 241, Changan St., Chidu Chiu, Keelung (TW)

( * ) Notice: Subject to any disclaimer, the term of this patent is extended or adjusted under 35 U.S.C. 154(b) by 0 days.

(21) Appl. No.: 09/916,431

(22) Filed: Jul. 30, 2001

(51) Int. Cl.[7] ..... F02B 33/44
(52) U.S. Cl. ..... 60/607; 60/605.1; 123/559.1
(58) Field of Search ..... 123/559.1, 566; 60/605.1, 607

(56) References Cited

U.S. PATENT DOCUMENTS 4,485,310 A * 11/1984 de Valroger ..... 290/52
4,935,656 A * 6/1990 Kawamura ..... 310/156
5,121,605 A * 6/1992 Oda et al. ..... 60/608
5,133,325 A * 7/1992 Winkelmann ..... 123/559.3
5,789,824 A * 8/1998 Selfors et al. ..... 290/52
6,145,314 A * 11/2000 Woollenweber et al. ..... 60/607

* cited by examiner

*Primary Examiner*—Hoang Nguyen
(74) *Attorney, Agent, or Firm*—Troxell Law Office PLLC

(57) ABSTRACT

An electric-controlled idler-type supercharger mainly includes a free rotor, an electric rotor, and an electric control gear mounted inside a turbine casing. The electric rotor includes an electromagnet screwed to a transmission shaft of the electric rotor, and the free rotor is rotatably mounted to an end of the transmission shaft with a permanent magnet thereof corresponding to the electromagnet. A conductive coil is wound around the electromagnet with two coil leads connected to two collector rings of the electric control gear. The collector rings are then connected to a power switch via two carbon brushes, two expansion springs and two conductive terminals. By turning the power switch on or off, it is possible to control working characteristics of the supercharger.

4 Claims, 3 Drawing Sheets

ELECTRIC-CONTROLLED IDLER-TYPE SUPERCHARGER

FIELD OF THE INVENTION

The present invention relates to an electric-controlled idler-type supercharger, and more particularly to an idler-type supercharger that includes a variable-field electromagnet and a permanent magnet (similar to the structure of a motor rotor) to determine the working characteristics thereof through electric control and thereby upgrades the output power of an internal combustion engine.

BACKGROUND OF THE INVENTION

Conventionally, the performance and output power of an internal combustion engine is enhanced through mounting of a turbocharger. Currently, there are two types of turbochargers available for use, namely, gas-driven and mechanically driven turbochargers. The latter further includes, for example, turbo-blower, mechanic turbine, idler-type turbocharger, etc.

In the case of gas-driven turbocharger, exhaust from the internal combustion engine is utilized to rotate an exhaust-side rotor of the turbocharger. Since the exhaust produces a high temperature, the gas-driven turbocharger must be specially designed and therefore requires high manufacturing and maintenance costs. Another disadvantage of the gas-driven turbocharger is it has considerable lag in work compared with a rotating speed of the crankshaft of the internal combustion engine.

In the case of mechanically driven turbocharger, it is directly driven by the internal combustion engine and would therefore consume a part of the engine transmission power.

In the case of idler-type turbocharger, the idler is rotated through an inertia effect of the crankshaft of the internal combustion engine and thereby causes the turbocharger to work. This type of turbocharger also has lag condition in its work.

Either the gas-driven or the mechanically driven turbocharger is restricted by conventional structures to have specific working characteristics. Moreover, both the conventional gas-driven and mechanically driven turbochargers involve complicate transmission processes and inevitably cause losses in mechanical efficiency thereof. It is therefore important to find a source of kinetic energy that has improved working characteristics to easily enhance the efficiency of the turbocharger with reduced power consumption.

SUMMARY OF THE INVENTION

A primary object of the present invention is to provide an electric-controlled idler-type supercharger that includes an electromagnet screwed to a transmission shaft of an electric rotor to correspond to a permanent magnet included in a free rotor. When a current is supplied to a conductive coil wound around the electromagnet, the electromagnet generates a magnet field to produce attractive or repulsive interaction with the permanent magnet, and thereby causes the turbine (that is, the free rotor) to rotate.

Another object of the present invention is to provide an electric-controlled idler-type supercharger that includes an electric control gear to determine the rotating speed and working manner of the turbine of the supercharger.

A further object of the present invention is to provide an electric-controlled idler-type supercharger that includes a simple electric control gear to achieve a supercharging effect superior to that could be achieved through conventional turbochargers.

To achieve the above and other objects, the electric-controlled idler-type supercharger of the present invention mainly includes:

- a turbine casing;
- a free rotor having a main body constituting a turbine, the turbine being internally provided at a predetermined position with a permanent magnet;
- an electric rotor including an electromagnet screwed to a transmission shaft thereof and a conductive coil wound around the electromagnet; and
- an electric control gear including two collector rings mounted around the transmission shaft, two carbon brushes separately connected to the two collector rings, two expansion springs having an end connected to the two carbon brushes and another end connected to two conductive terminals that are projected from the turbine casing to connect to an external selective switch for selecting a working manner for the supercharger.

The free rotor is rotatably mounted around an end of the transmission shaft through a roller bearing and fixing pins, such that the permanent magnet corresponds to the electromagnet of the electric rotor.

The conductive coil having two coil leads separately connected to the two collector rings of the electric control gear; and the free rotor, the electric rotor, and the electric control gear all are mounted in the turbine casing.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
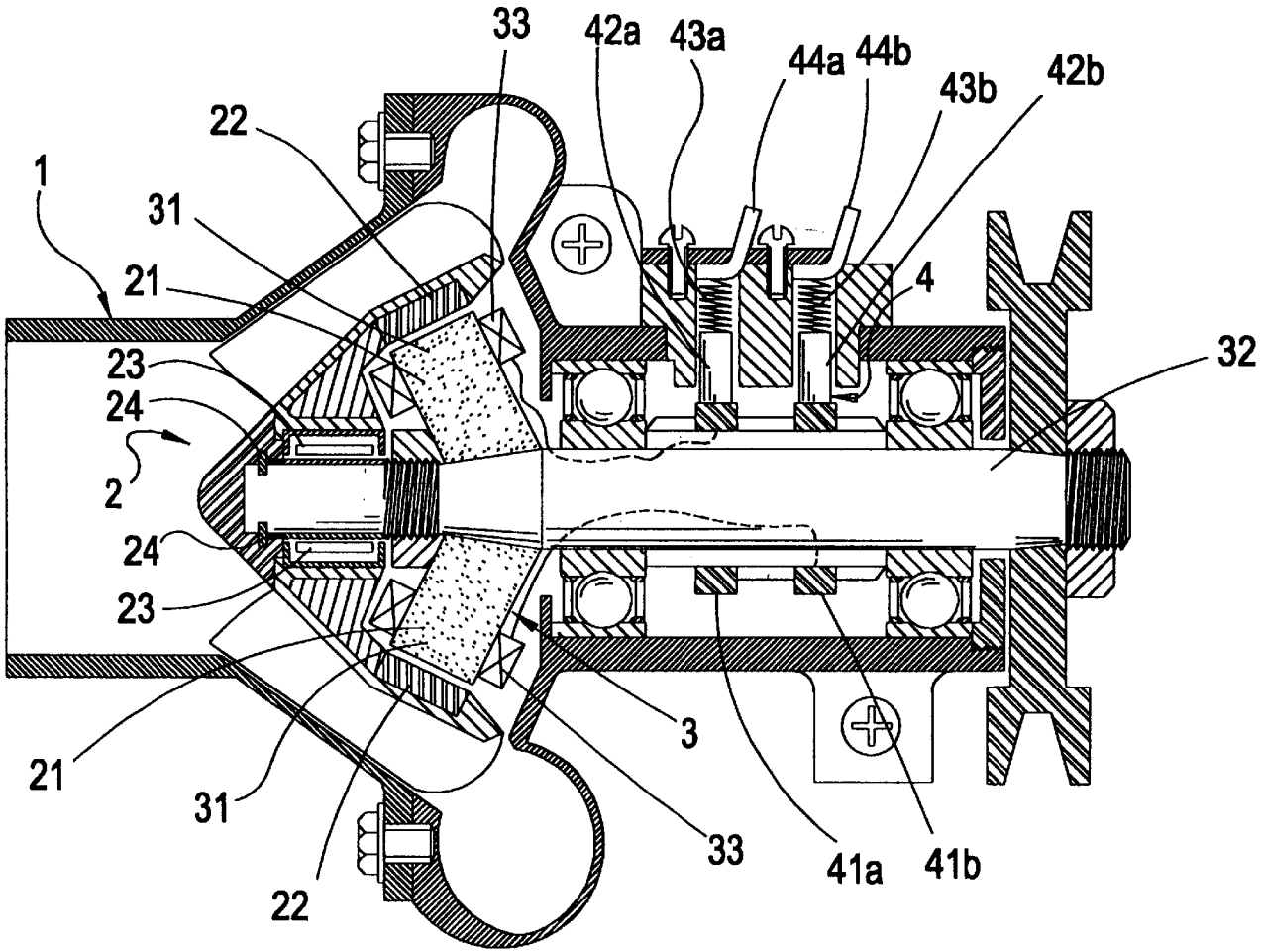
FIG. 1 is a sectional view of an electric-controlled idler-type supercharger according to the present invention.

Please refer to FIG. 1 that is a sectional view of an electric-controlled idler-type supercharger of the present invention. As shown, the electric-controlled idler-type supercharger mainly includes a turbine casing 1, a free rotor 2, an electric rotor 3, and an electric control gear 4.

The free rotor 2 has a main body that constitutes a turbine 21. The turbine 21 is internally provided at a predetermined position with a permanent magnet 22. The electric rotor 3 includes an electromagnet 31 screwed to a transmission shaft 32 of the electric rotor 3 and a conductive coil 33 wound around the electromagnet 31. The electric control gear 4 includes two collector rings 41*a*, 41*b* mounted around the transmission shaft 32 to space from each other, two carbon brushes 42*a*, 42*b* respectively connected to one side of the collector rings 41*a*, 41*b*, two expansion springs 43*a*, 43*b* respectively connected at an inner end to the carbon brushes 42*a*, 42*b*, and two conductive terminals 44*a*, 44*b* having inner ends respectively connected to outer ends of the two expansion springs 43*a*, 43*b* and outer ends located outside the turbine casing 1 to connect to a three-stage selective switch (not shown).

When the electric control gear 4 is supplied with an electric current, the electromagnet 31 of the electric rotor 3 generates a magnetic field. The free rotor 2 is connected to an end of the transmission shaft 32 through a roller bearing 23 and fixing pins 24, such that an attractive or repulsive interaction exists between the permanent magnet 22 of the free rotor 2 and the electromagnet 31 of the electric rotor 3. Two coil leads of the conductive coil 33 are connected to the two collector rings 41*a*, 41*b* of the electric control gear 4. The free rotor 2, the electric rotor 3, and the electric control gear 4 all are mounted inside the turbine casing 1.

Figure 2:
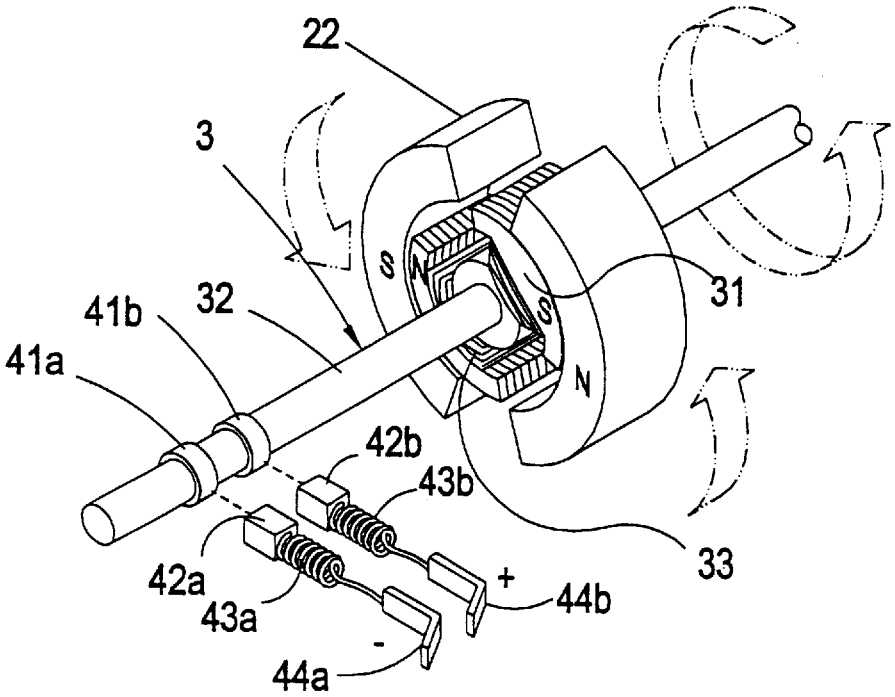
FIG. 2(A) is a perspective view showing the manner in which the electric-controlled idler-type supercharger of FIG. 1 works.
FIG. 2(B) is a working circuit diagram of the electric-controlled idler-type supercharger of FIG. 1.
Figure 2:
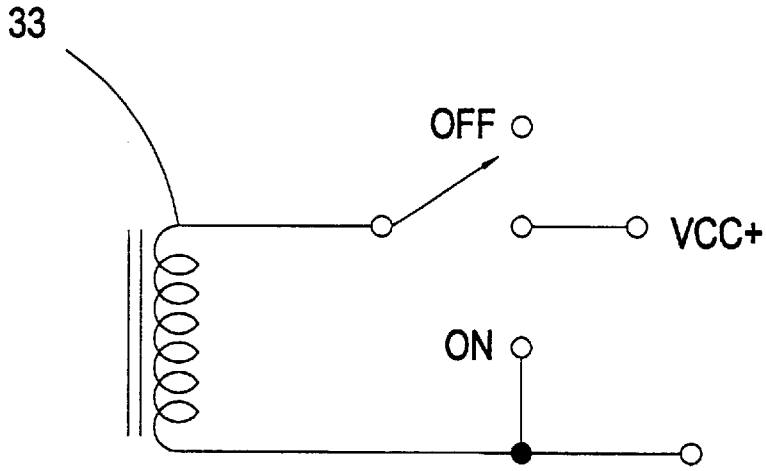

Please refer to FIG. 2(A) that is a perspective view showing a working principle of the electric-controlled idler-type supercharger of the present invention. When the selective switch is at an "OFF" point "A" as shown in FIG. 2(B), the conductive coil 33 of the electric rotor 3 is in an open-circuited condition. At this point, the turbine 21 of the free rotor 2 is dragged by an inertia force of the electric rotor 3 to rotate. That is, the turbine 21 rotates under an inertia effect just like a conventional idler-type supercharger. And, when the selective switch is at an ON point "B" as shown in FIG. 2(B), the conductive coil 33 of the electric rotor 3 is in a close-circuited condition. At this point, the coil 33 is cut by magnetic lines generated by the permanent magnet 22 of the free rotor 2 and thereby generates an electric current. The current flows through the conductive terminals 44*a*, 44*b*, the expansion springs 43*a*, 43*b*, the carbon brushes 42*a*, 42*b*, and the collector rings 41*a*, 41*b* to return to the conductive coil 33, forming a loop circuit and a magnetic field reverse to the magnetic lines generated by the permanent magnet 22 of the free rotor 2. Therefore, the free rotor 2 is pushed by the reverse magnetic field generated by the conductive coil 33 of the electric rotor 3 to rotate. This is similar to a working principle of a cage motor. At this point, the free rotor 2 has a rotating speed very close to that of the electric rotor 3 with only a minor lag about an angle of 5 to 10 degrees. When a suitable voltage is applied to the conductive coil 33 of the electric rotor 3 and the selective switch is at the ON point "B", the electromagnet 31 of the electric rotor 3 generates a magnetic field. The magnetic field generated by the electric rotor 3 and the magnetic field generated by the permanent magnet 22 of the free rotor attract each other, enabling the free rotor 3 to rotate at a speed the same as that of the electric rotor 3.

Figure 3:
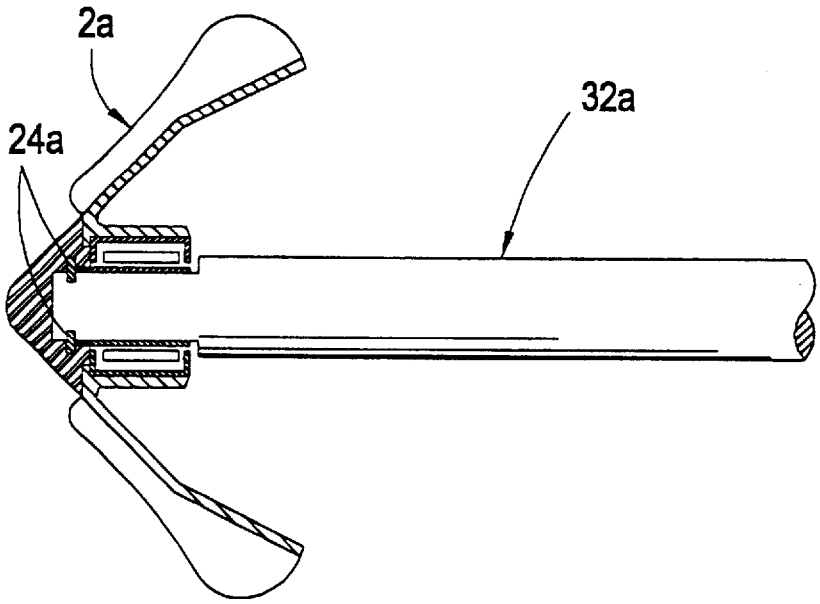
FIG. 3(A) is a sectional view of a free rotor for a conventional idler-type supercharger.
FIG. 3(B) is a sectional view of a free rotor and electric rotor for the electric-controlled idler-type supercharger of the present invention.
Figure 3:
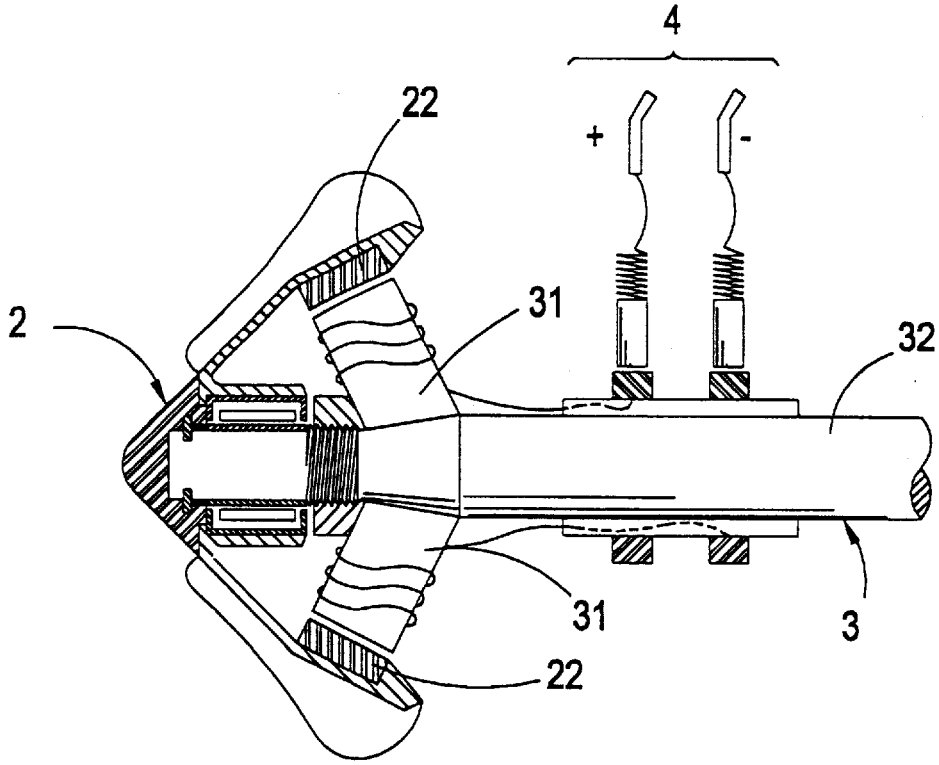

Please refer to FIG. 3(A) that is a sectional view of a free rotor for a conventional idler-type supercharger and FIG. 3(B) that is a sectional view showing free and electric rotors for the electric-controlled idler-type supercharger of the present invention. From a comparison of FIG. 3(A) with FIG. 3(B), it can be found that the conventional idler-type supercharger of FIG. 3(A) uses only a transmission shaft 32*a* to drive a free rotor 2*a* that is an idler fixedly mounted on the transmission shaft 32*a* by means of fixing pins 24*a*. Since the free rotor 2*a* is an idler being rotated through an inertia effect, there is a lag in the motion of the free rotor as compared with the motion of the transmission shaft 32*a*. Under this condition, the free rotor 2*a* is not able to work at high efficiency when the transmission shaft 32*a* rotates at low speed. That is, the free rotor 2*a* fails to transfer energy produced by the transmission shaft 32*a* when the latter rotates at low speed. And, the free rotor 2*a* is not able to quickly reduce its rotating speed when the transmission shaft 32*a* dramatically reduces its high rotating speed.

On the contrary, the electric-controlled idler-type supercharger of the present invention has a permanent magnet 22 connected to the free rotor 2 and an additional electromagnet 31 fixedly connected to the transmission shaft 32, as described above. This arrangement enables the free rotor 2 to work in a high efficiency no matter what the rotating speed is for the transmission shaft 32. Through regulation of the electric control gear 4, the lag effect in the supercharger is largely reduced. And, the supercharger may work in a selected manner.

The electric-controlled idler-type supercharger of the present invention has the following advantages over the prior art:

1. It has simple structure to enable easy installation and maintenance, as well as low manufacturing cost.

2. Its performance could be regulated through independent control of the electric control gear.

3. It has good working curve and high mobility to determine the loss of engine power depending on actual need.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An electric-controlled idler-type supercharger, comprising:

a turbine casing;

a free rotor having a main body constituting a turbine, said turbine being internally provided at a predetermined position with a permanent magnet;

an electric rotor including an electromagnet screwed to a transmission shaft of said electric rotor and a conductive coil wound around said electromagnet; and an electric control gear including two collector rings mounted around said transmission shaft, two carbon brushes separately connected to said two collector rings, two expansion springs having an end connected to said two carbon brushes and another end connected to two conductive terminals;

said free rotor being rotatably mounted around an end of said transmission shaft, such that said permanent magnet of said free rotor is at a position corresponding to said electromagnet of said electric rotor;

said conductive coil having two coil leads separately connected to said two collector rings of the electric control gear; and said free rotor, said electric rotor, and said electric control gear all being mounted in said turbine casing.

2. The electric-controlled idler-type supercharger as claimed in claim 1, wherein said two conductive terminals are projected from said turbine casing to connect to two electrodes of a power supply.

3. The electric-controlled idler-type supercharger as claimed in claim 1, wherein said free rotor is connected to said transmission shaft through a roller bearing and fixing pins.

4. The electric-controlled idler-type supercharger as claimed in claim 1, wherein said electromagnet of said electric rotor generates a magnet field when said electric control gear is supplied with an electric current.

* * * * *